US006877262B2

(12) United States Patent
Bianco

(10) Patent No.: US 6,877,262 B2
(45) Date of Patent: Apr. 12, 2005

(54) PERPETUAL CALENDAR

(76) Inventor: Ronald Bianco, 599 Nyes Pl., Laguna Beach, CA (US) 92651

( * ) Notice: Subject to any disclaimer, the term of this patent is extended or adjusted under 35 U.S.C. 154(b) by 0 days.

(21) Appl. No.: 10/617,293

(22) Filed: Jul. 10, 2003

(65) Prior Publication Data

US 2005/0005483 A1 Jan. 13, 2005

(51) Int. Cl.[7] ..... G09D 3/10

(52) U.S. Cl. ..... 40/118; 40/107; 40/109; 40/117

(58) Field of Search ..... 40/107, 109, 116, 40/117, 118, 482, 483, 484, 514, 518

(56) References Cited

U.S. PATENT DOCUMENTS

| | | | | | |
|---|---|---|---|---|---|
| 1,042,337 | A | | 10/1912 | Gorin | |
| 1,310,428 | A | | 7/1919 | Moerk | |
| 1,345,150 | A | * | 6/1920 | Edwards | 40/117 |
| 1,421,379 | A | * | 7/1922 | Bartlett | 40/109 |
| 1,430,212 | A | * | 9/1922 | Brabant | 40/109 |
| 1,459,236 | A | | 6/1923 | Orth | |
| 1,772,112 | A | | 8/1930 | Rose | |
| 1,783,302 | A | * | 12/1930 | Newton | 40/117 |
| 2,193,277 | A | | 3/1940 | Gordon | |
| 2,340,153 | A | | 1/1944 | Stewart | |
| 2,499,329 | A | * | 2/1950 | Potter | 40/109 |
| 2,505,341 | A | | 4/1950 | Rankin | |
| 2,575,929 | A | | 11/1951 | Roesholm | |
| 3,289,336 | A | | 12/1966 | Weiner et al. | |
| 3,609,896 | A | | 10/1971 | Hussar | |
| 3,883,970 | A | * | 5/1975 | Campbell, Jr. | 40/110 |
| D258,811 | S | | 4/1981 | You | |
| 4,567,680 | A | | 2/1986 | DePaolo, Sr. | |
| 4,703,571 | A | | 11/1987 | McCarthy | |
| 4,852,282 | A | | 8/1989 | Selman | |
| 5,195,262 | A | | 3/1993 | Roane | |
| 5,313,722 | A | | 5/1994 | Ackerman | |
| 5,657,561 | A | | 8/1997 | Zykov | |
| 5,930,924 | A | | 8/1999 | Beard | |
| 6,631,573 | B1 | * | 10/2003 | Alba | 40/118 |

* cited by examiner

*Primary Examiner*—Gary C. Hoge
(74) *Attorney, Agent, or Firm*—Christie, Parker & Hale, LLP

(57) ABSTRACT

A perpetual monthly calendar includes a front panel with a month grid of cells capable of displaying an accurate number and configuration of cells for any month. This embodiment also includes an at least semi-transparent sheet in front of the front panel with a write-on/wipe-off surface.

Another embodiment includes a front panel, a first surface with a first number matrix, and a second surface with a second number matrix. The front panel displays a grid of cells with columns representing weekdays and rows representing the upper rows of a calendar and at least one lower row of a calendar. A window is cut out of the front panel in each cell, so that when the first surface or second surface is moved horizontally, the front panel displays an accurate number and configuration of days for any month.

18 Claims, 9 Drawing Sheets

PERPETUAL CALENDAR

BACKGROUND

Monthly calendars are typically constructed with at least twelve sheets of paper with a single month in one particular year displayed on each sheet. Because the first weekday in each month varies monthly and yearly, each sheet of such a calendar is typically obsolete after the particular month has ended, and a user must display a separate sheet to accurately convey the current month. Likewise, an entire calendar is typically obsolete after the particular year has ended, and a user must discard the entire calendar and replace it with a calendar displaying the accurate configuration of days for the current year.

To counter this problem, several "perpetual calendars" have been invented that allow a single calendar to be reused to display multiple months of multiple years with the appropriate starting weekday.

One such calendar is described in U.S. Pat. No. 1,042,337 to Gorin. In this patent, a web or ribbon is horizontally movable behind an opaque glass front. The web or ribbon includes dates of a month arranged in columns or series so that when it is horizontally displaced, an opening in the glass front exposes the consecutive numbers 1–31 beginning on any weekday of the month. When the month has ended, a button of the last day of the month is pressed, and the web or ribbon is displaced to expose the days of the next month as beginning on the day after the weekday of the button pressed.

Although this perpetual calendar allows for a different starting day of each month, the user must read an alternate dial showing the usual number of days in the past month and press the relevant button to change the arrangement of days. This perpetual calendar also displays thirty-one days for every month, regardless of whether the month includes 28, 29, 30 or 31 days. This calendar also includes bulky and expensive mechanisms for translating the motion of the button to the change of the month and day configuration, such that if the user presses the wrong button, the user must recalculate the last day of the month and continue pressing that button until the proper month is again displayed.

Another perpetual calendar is described in U.S. Pat. No. 1,459,236 to Orth. This patent describes a perpetual calendar with adjustable knobs for the year, month and first day of the week for a given month. The knob for the first day of the week operates by horizontally displacing a web similarly to Gorin's perpetual calendar described above, but serves to display dates only for the upper four weeks of a current month. When turned, a fourth knob vertically displaces a second web to display one of twenty-one horizontal lines representing each of the possible date configurations of the last two weeks of a month. Although the Orth calendar therefore allows a user to display only the existing days for a month, including a leap year in February, a user must continue turning this fourth knob through many horizontal lines until the accurate number and configuration of days appear for the latter two weeks.

In a conventional calendar, a user may write notes directly onto the calendar pages to ensure that events, such as birthdays or meetings, are remembered on the correct day. Because the month page in a conventional calendar is obsolete at the month's end, the page can merely be torn off and thrown away. Because the month grid is reused in the perpetual calendars discussed above, any markings on the grid would be carried on to every month, causing confusion and inaccuracy.

Accordingly, a need exists for a perpetual monthly calendar that addresses one or more of these problems, allowing for an easier operation, write-on capability and/or simpler construction. Other objects, advantages, features and results will more fully appear in the course of the following description.

SUMMARY

The invention relates to a perpetual calendar. In one embodiment, the calendar includes a front panel with a month grid of cells and weekdays permanently displayed on it. The front panel is capable of displaying an accurate number and configuration of any month. This embodiment also includes an at least semi-transparent sheet with a write-on/wipe-off surface.

In one embodiment, a front panel has a month grid of cells and weekday labels permanently printed on in it, the cells having windows. At least one surface, which is coupled to and movable behind the front panel, has numbers permanently printed on it and spaced so that when the at least one surface is moved, an accurate number and configuration of days for any month can be displayed through the windows. An at least semi-transparent sheet is coupled to and in front of the front panel and has a write-on/wipe-off surface.

According to another embodiment, a perpetual monthly calendar includes a front panel, a first surface with a first number matrix, and a second surface with a second number matrix. The front panel displays a grid of cells with columns representing weekdays and rows representing the upper rows of a calendar and at least one lower row of a calendar. A window is cut out of the front panel in each cell.

The first surface is coupled to the front panel and is horizontally movable behind the upper rows and the second surface is coupled to the front panel and is horizontally movable behind the at least one lower row.

In this embodiment, the first number matrix is arranged so that by moving the first surface horizontally in relation to the front panel, a plurality of numbers of the first number matrix is visible through a plurality of windows in the upper rows. The first number matrix is also arranged so that the numbers visible through the windows can accurately represent sequential dates of the upper rows of a calendar for a month starting on any weekday. The second number matrix is arranged so that by moving the second surface horizontally in relation to the front panel, at least one of the numbers in the second number matrix is visible through at least one window in the at least one lower row, and can accurately represent sequential dates for the at least one lower row of a calendar for a month beginning on any weekday and an accurate number of days for any month.

BRIEF DESCRIPTION OF THE DRAWINGS

The detailed description of embodiments of the invention will be made with reference to the accompanying drawings, wherein like numerals represent corresponding parts of the figures.

DETAILED DESCRIPTION

Figure 1:
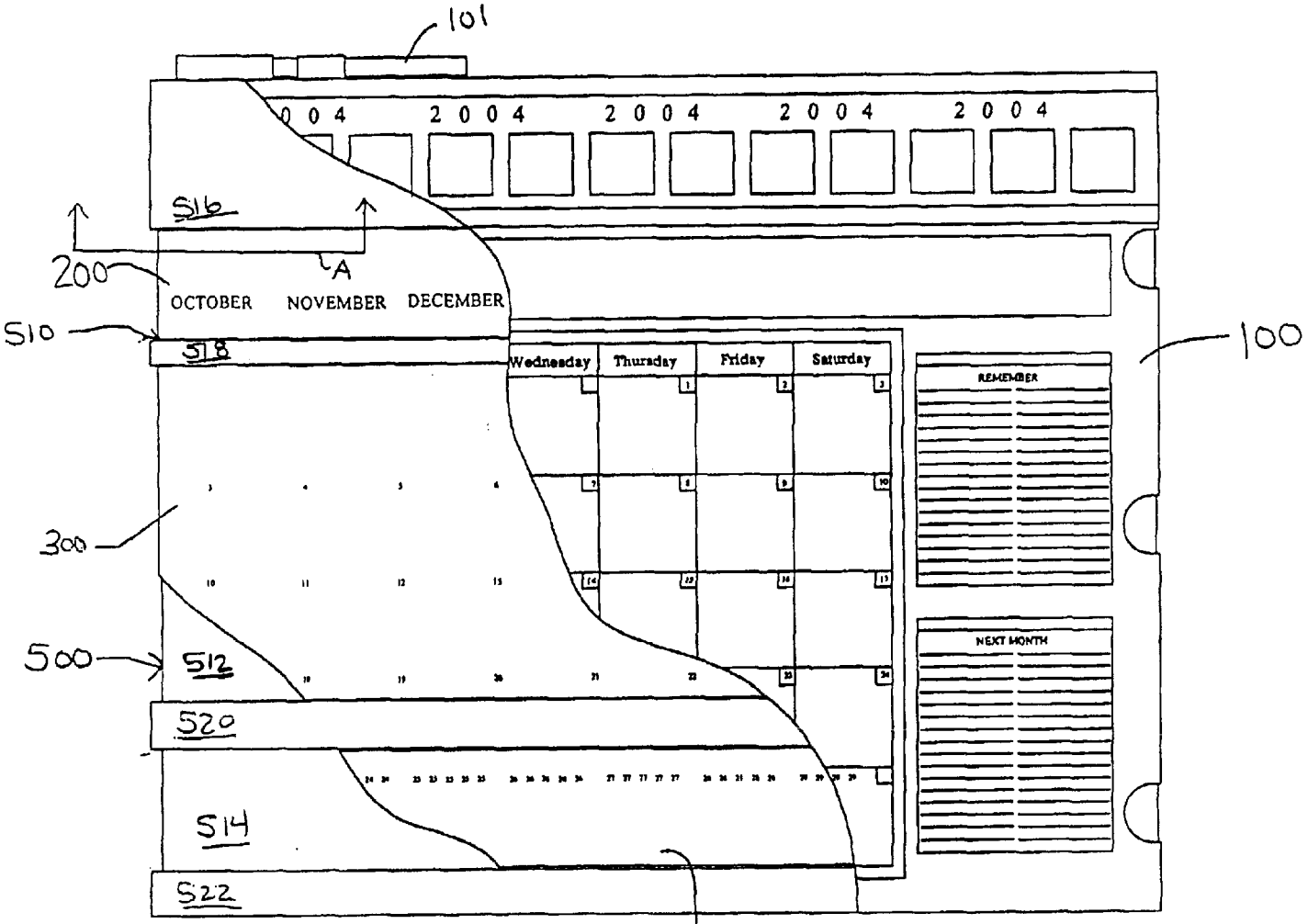
FIG. 1 is a cutaway front view an assembled calendar, according to one embodiment of the invention.

Embodiments of the instant invention are directed to a perpetual calendar and operation thereof. In relation to FIG. 1, one embodiment of a calendar 1 includes a front panel 100 in front of and partially covering a month scroll 200, an upper date scroll 300, and a lower date scroll 400 that horizontally glide along tracks 510, 512, 514 on a base 500. The upper date scroll 300 is located above of the lower date scroll 400 on the base 500.

The month scroll 200, upper date scroll 300 and lower date scroll 400 are formed as loops around the tracks 510, 512 and 514, respectively, of the base 500. The scrolls 200, 300, and 400 are kept in vertical alignment by sitting between raised portions 516, 518, 520 and 522 of the base 500.

In this embodiment, a wet or dry erase marker 101 is removably attached to the top of the calendar 1.

Figure 2:
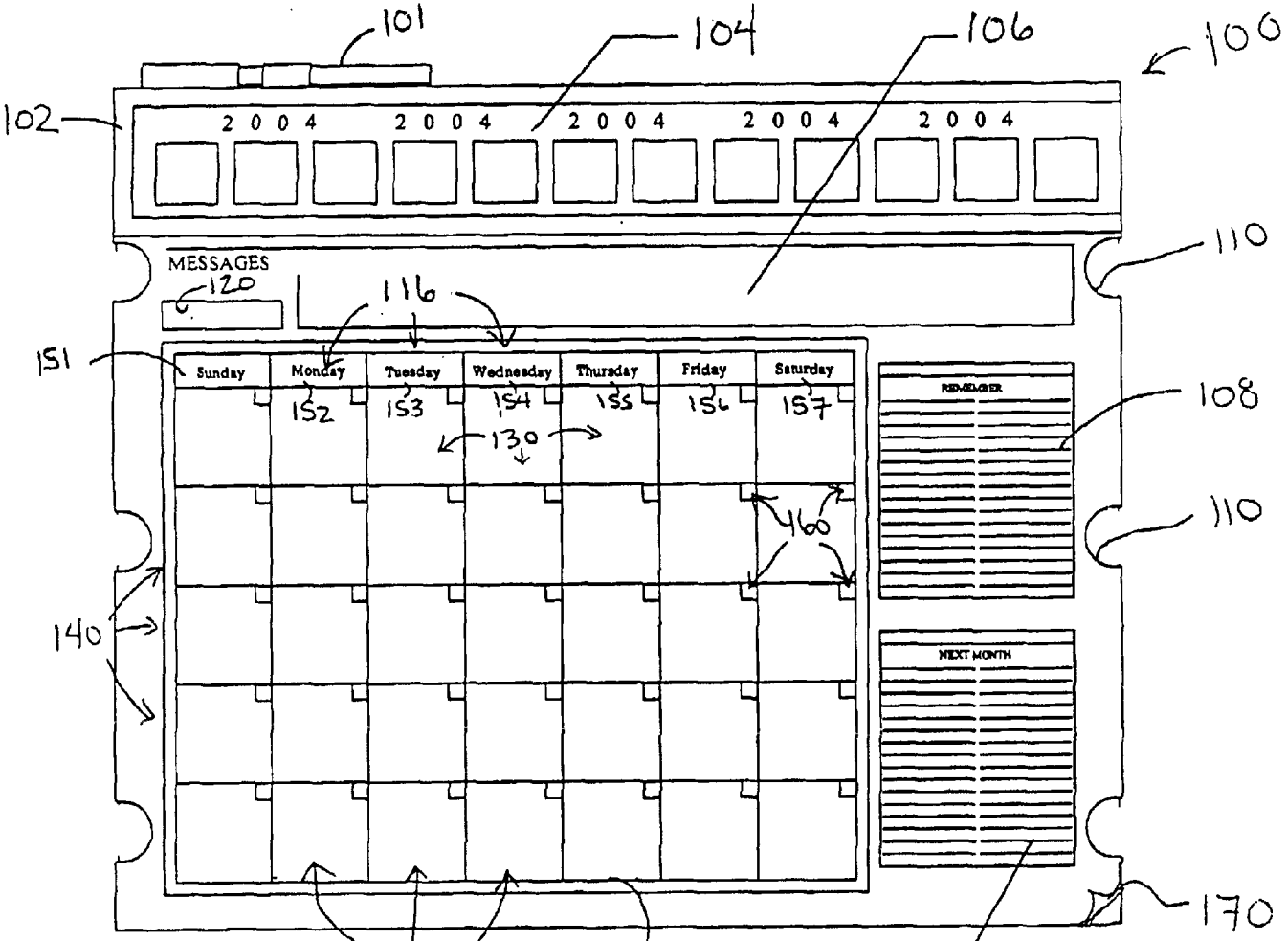
FIG. 2 is a view of the front panel of the embodiment shown in FIG. 1.

FIG. 2 depicts the front panel 100 in more detail. A month grid 114 of cells 130, arranged in rows 140 and columns 150, is displayed on the front panel 100. Weekdays 116 are displayed directly above each column 151-157 of the month grid 114. Each cell 130 includes in a corner a date window 160 that is cut out from the front panel 100 to expose a portion of either the upper date scroll 300 (not shown) or the lower date scroll 400 (not shown).

A month window 120 is cut out of the front panel 100 to display a portion of the month scroll 200 (not shown) beneath it.

The front panel 100 of the current embodiment also includes finger notches 110 disposed along the sides of the front panel 100 that allow the month scroll 200 (not shown), upper date scroll 300 (not shown) and lower date scroll 400 (not shown) to be horizontally moved by a user. Although side finger notches 110 are described in the pictured embodiments, one skilled in the art will understand that any mechanism capable of moving the scrolls horizontally from the front and/or the back of the front panel 100 would be acceptable. For example, a horizontal line can be cut into the center of the front panel 100 to allow a finger to push the scroll or a tab projecting outward from and connected to the scroll can be moved horizontally to horizontally displace the scroll.

The front panel 100 of this embodiment also includes other useful tools, such as a year-in-view receiving area 102, a year-in-view insert 104 that can slide into the receiving area 102, a message area 106, a reminder pad 108 and a next month pad 112.

A transparent plastic layer 170 with a write-on/wipe-off surface is added to the front of the front panel 100. A "write-on/wipe-off surface" is a surface capable of displaying ink from a wet or dry erase marker and erasing the ink when a wet or dry cloth, respectively, is wiped across it. In this embodiment, a wet or dry erase marker 101 can be used to write messages or notes directly onto the calendar 1. When the user wishes to erase these marks to clear the calendar 1 for the next month, the user can simply wipe the transparent plastic layer 170 with a wet or dry cloth. In one embodiment, an additional protective layer (not shown) can be removably attached to the transparent plastic layer 170 so that incidental contact with the front of the calendar 1 will not contact the ink from a dry erase marker that would cause the ink to wipe off unless the additional layer is lifted or removed.

Figure 3:
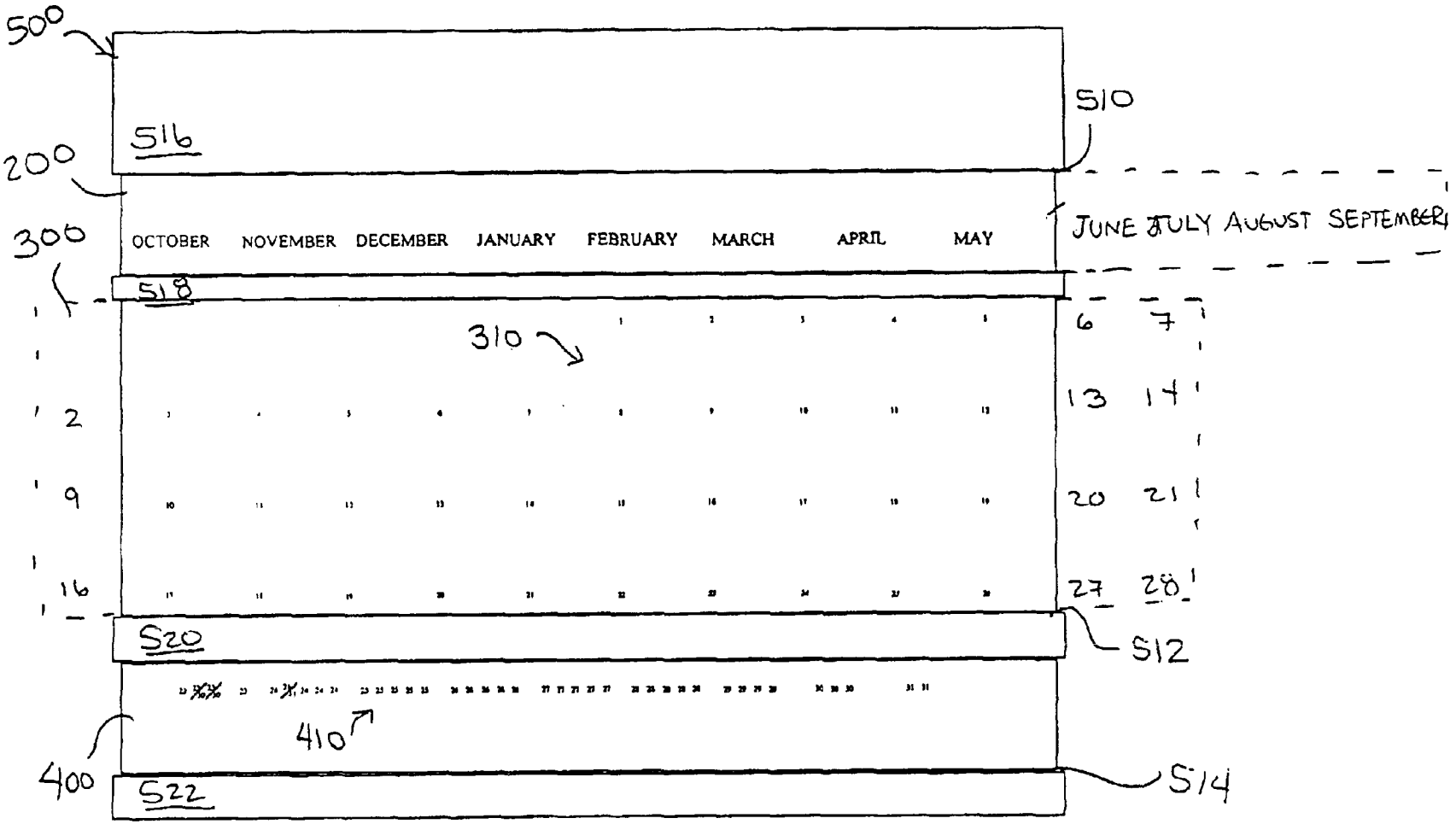
FIG. 3 is a view of the embodiment shown in FIG. 1 with the front panel removed with portions of the scrolls that are looped toward the rear shown in phantom lines.

FIG. 3 shows the calendar 1 with the front panel 100 removed to show the scrolls 200, 300 and 400 in better detail. The portions of the scrolls 200, 300 and 400 that are looped toward the rear of the calendar 1 are shown in phantom lines. The month scroll 200 displays each month of the year in a horizontal line and is looped around the track 510 and vertically positioned between raised portions 516 and 518 of the base 500. Each month is sized to be individually displayed in the month window 120 (shown in FIG. 2) when the month is directly behind it. Different months can be displayed through the month window 120 when a user forces the month scroll 200 to move horizontally by friction through the finger notches 110 (shown in FIGS. 1 and 2).

Likewise, with reference to FIGS. 1 and 3, the upper date scroll 300 displays a matrix of dates 310 in four, horizontal parallel lines, and is looped around the track 512 and vertically positioned between raised portions 518 and 520 of the base 500. The matrix of dates 310 is arranged in four rows and thirteen columns as shown, with the date in each column increasing by seven and the date in each row increasing by one. The numbers are arranged so that each date of the month may be displayed through the date windows 160 of the top four rows of the month grid 114 when the front panel 100 is in front of the upper date scroll 300 as shown in FIG. 1. Like the month scroll 200, the upper date scroll 300 can be horizontally displaced by friction force through the finger notches 110.

The lower date scroll 400 is looped around the track 514 and vertically positioned between raised portions 520 and 522 of the base 500. The lower date scroll 400 in this embodiment displays one horizontal array of numbers 410 progressing from "23" on the far left to "31" on the far right of the scroll 400.

Each date may appear in different columns in the last row of a traditional calendar. Likewise, months can have a total number of days anywhere from twenty-eight to thirty-one. There are four different possible end dates for each month, and the last row of a calendar can include an overlap date, such as "24/31," or no date at all for some weekdays occurring after the last date in a month. Therefore, each date in the horizontal array of numbers 410 is repeated several times to allow for different configurations of the last line of the calendar 1. Although the embodiment described includes only one horizontal array of numbers that includes overlapping numbers, it is also within the scope of the invention to include two horizontal arrays that show the overlapping day in a lower row of the month grid 114.

For example, if the first of the month falls on a Saturday (the column 157), the last line of the calendar would include "23" or "23/30" in the column 151 and "24" or "24/31", in the column 152. Likewise, if the month is February, for example, no numbers should appear in any columns 150 after the column displaying "28" (or "29" in leap year).

The horizontal array of numbers 410 on the lower date scroll 400, therefore, repeats each date for the necessary number of times to allow only the accurate dates, number of days or overlapping dates for the chosen month to show through the date windows 160 on the bottom row 140 of the month grid 114. The horizontal array 410 of the lower date scroll 400 can therefore be configured as shown in FIG. 3.

Although the embodiments described refer to looped scrolls 200, 300 and 400, is it also within the scope of the invention for the month and date arrays displayed on the scrolls to be displayed on any surface that is horizontally displaceable behind the front panel. Therefore, a flat surface or a surface laced around a pair of axially rotatable spindles, for example, can be substituted for the looped scroll of the described embodiments.

Figure 4:
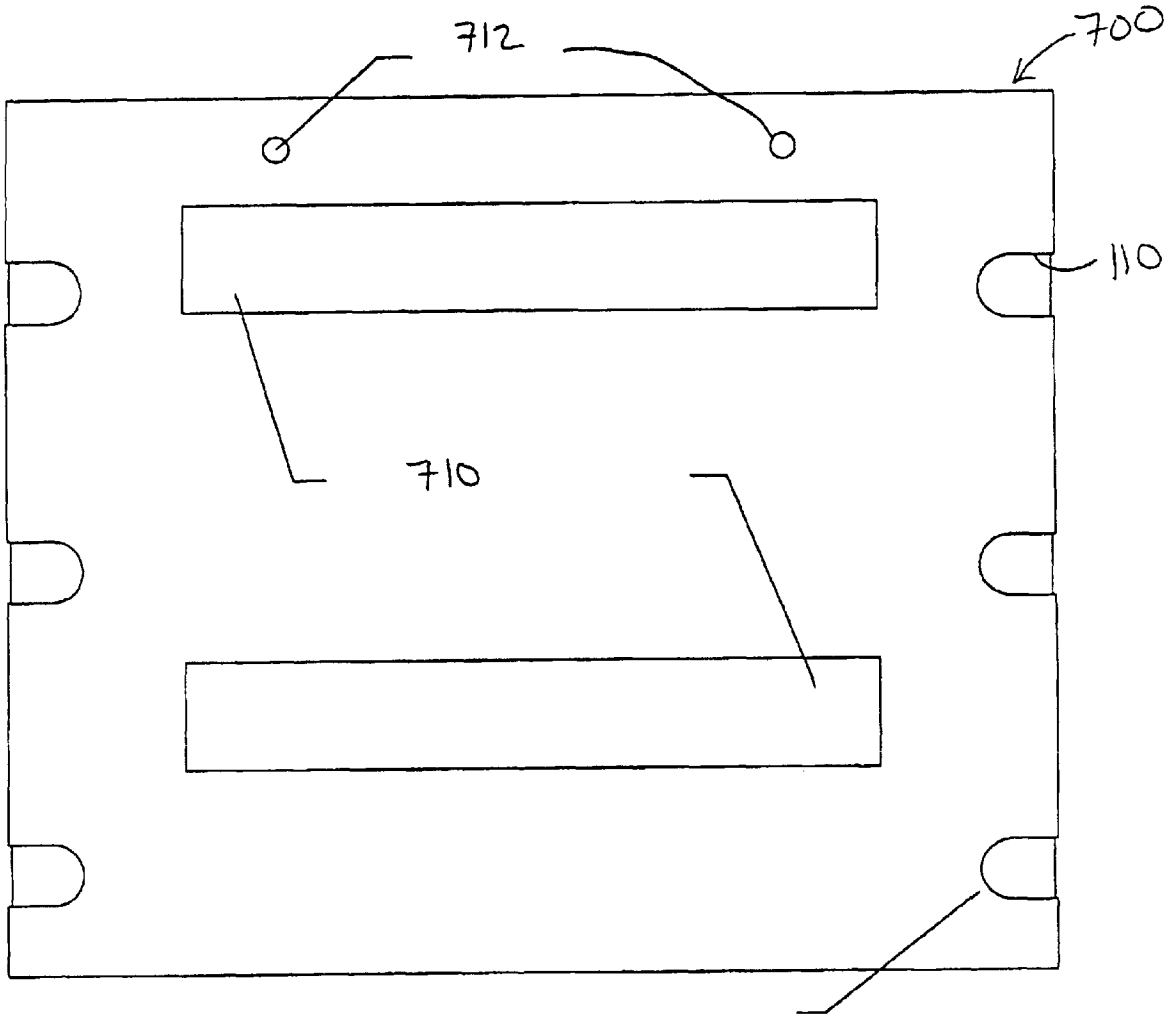
FIG. 4 is a rear view of the assembled calendar shown in FIG. 1.

FIG. 4 is a rear view of the embodiment shown in FIG. 1. In the pictured embodiment, a rear panel 700 includes finger notches 110 along the side edges of the panel to allow for improved gripping of the scrolls. Magnetic strips 710 are mounted on the rear panel 700 for securing the calendar 1 to a refrigerator or metal object (not shown). One skilled in the art will recognize that any substance, such as glue or Velcro (TM), capable of at least temporarily securing the calendar 1 to an object can be used in place of the magnetic strips 710. Mounting holes 712 are also included on the rear panel 700 for hanging the calendar from a nail, screw, or the like. One skilled in the art will recognize that any coupling mechanism, such as a hook or snap, etc., can be used to hold the calendar 1 in place on an object.

Figure 5A:
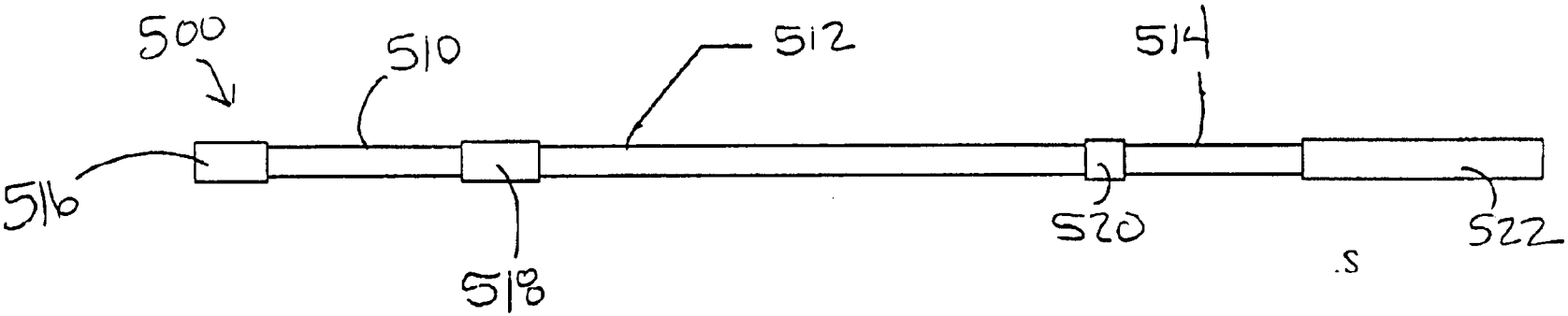
FIG. 5*a* is an end view of one embodiment of a base.
Figure 5B:
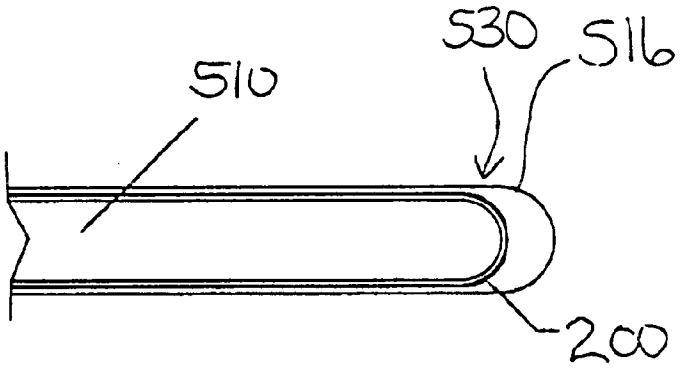
FIG. 5*b* is a cross-sectional top view along line A of FIG. 1 of the base board of FIG. 5*a;*

The base 500 is shown in more detail in FIGS. 5*a* and 5*b*. FIG. 5*b* shows a cross-section along line A of FIG. 1. The base 500 includes tracks 510, 512 and 514 that preferably have a smooth surface on which the scrolls 200, 300 (FIG. 3) and 400 (FIG. 3) can slide. The edges 530 of the tracks 510, 512 and 514 are preferably rounded from the front of the calendar 1 to the back to minimize the friction between the tracks 510, 512 and 514 and the scrolls 200, 300 and 400 to allow the friction of the user's finger to push or pull the scrolls 200, 300 and 400 horizontally around the tracks 510, 512 and 514, respectively.

Figure 6A:
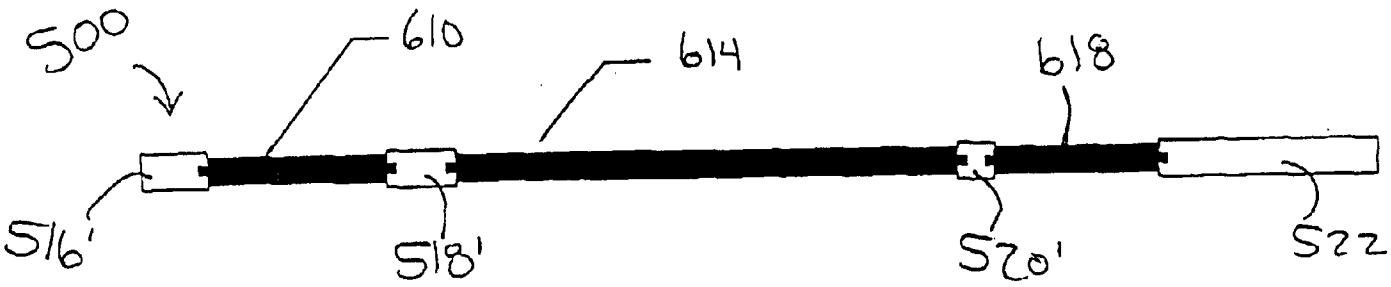
FIG. 6*a* is an end view of another embodiment of a base board.
Figure 6B:
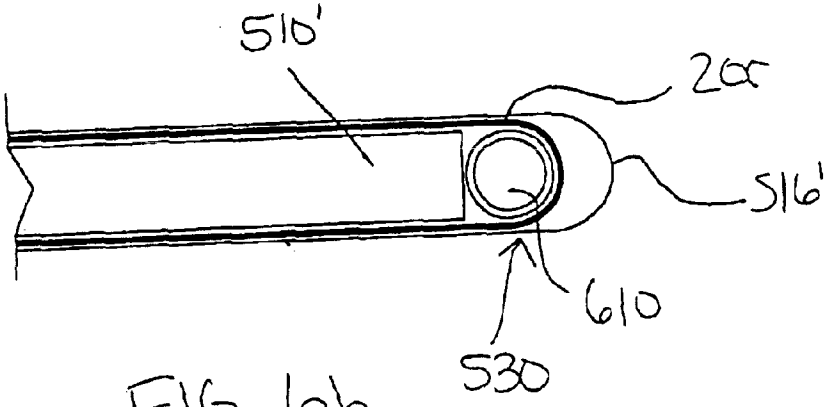
FIG. 6*b* is a cross-sectional top view along line A of FIG. 1 of the base board of FIG. 6*a;*

Alternatively, with reference to FIGS. 6*a* and 6*b*, roller rods 610, 614 and 618 can be positioned adjacent to the edges 530' of the tracks 510', 512' and 514' and rotatably mounted to the raised portions 516', 518', 520' and 522'. The scrolls 200, 300 and 400 are then looped around the roller rods 610, 614 and 618 and the tracks 510', 512' and 522'. Thus, the user can grasp and rotate the scrolls 200, 300 and 400 with the roller rods 610, 614 and 618, thereby causing the scrolls 200, 300 and 400 to glide along the tracks 510', 512' and 514' freely.

As described above, the tracks can also be replaced by axially rotatable spindles that each attach to one end of one scroll and rotatable in response to the user's rotation of a vertical projection of the spindle.

With reference to FIGS. 1–5*b*, the calendar 1 of FIG. 1 can be constructed by first providing a base 500, which can be made from any solid material, such as paper, wood, plastic, metal, or any combination of materials, and forming the tracks 510, 512, and 514 from recessed portions of the base 500.

Months of the year, the matrix of numbers displayed on the upper date scroll, and the matrix of numbers displayed on the lower date scroll, as described above in relation to FIG. 3, can be printed on strips of flexible material, such as, for example, paper or high density polyethylene (HDPE) material. Scrolls 200, 300 and 400 can then be formed by winding the strips of flexible material around the tracks 510, 512 and 514, respectively, and the ends of the strips of material connected to each other to form a loop.

The front panel 100 can be constructed out of any solid material, such as paper, plastic, wood, metal, etc. The month grid 114 with weekdays 116 and any additional message or writing areas 106 can then be printed on the panel. Finger notches 110, month windows 120 and day windows 160 can be cut out from the panel at a size that is large enough to view the month and dates displayed behind the panel 100 on the scrolls 200, 300 and 400. Any reminder pads 108 or next month pads 112 can be affixed to the panel 100 by any adhesive, such as, for example, glue. The year-in-view receiving area 102 can be formed by adhering a three-sided frame to the panel 100, allowing the year-in-view insert 104 to slide through the open side and be held in place by the remaining three sides.

The transparent plastic layer 170 can be added to the front panel 100 by lamination or fixing a clear, write-on/wipe-off surface onto the front panel 100 so that it hangs over the month grid 114. One skilled in the art will understand that the layer 170 can adhere or can simply sit in front of the front panel 100 so that writing on the layer 170 can visually coordinate with the location of the month grid 114 and messages area 106 of the front panel 100.

The front panel 100 and the rear panel 700 can be affixed to the front and back, respectively, of the top and bottom raised portions 516 and 522 of the base 500 or any other location of the base that would not interfere with the horizontal displacement of the scrolls 200, 300 and 400.

Figure 7:
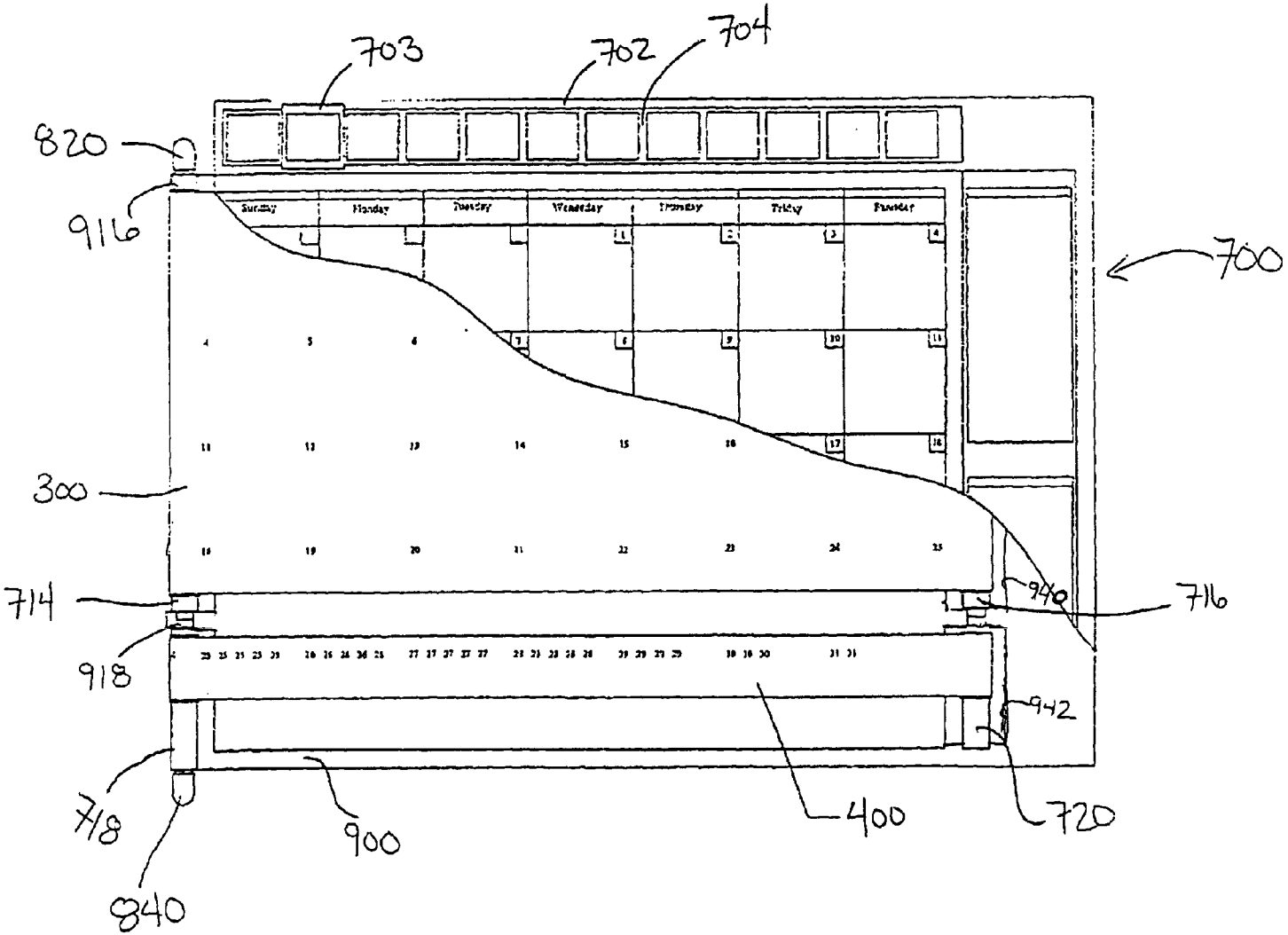
FIG. 7 is a cutaway front view of an assembled calendar according to an alternate embodiment of the invention.
Figure 8:
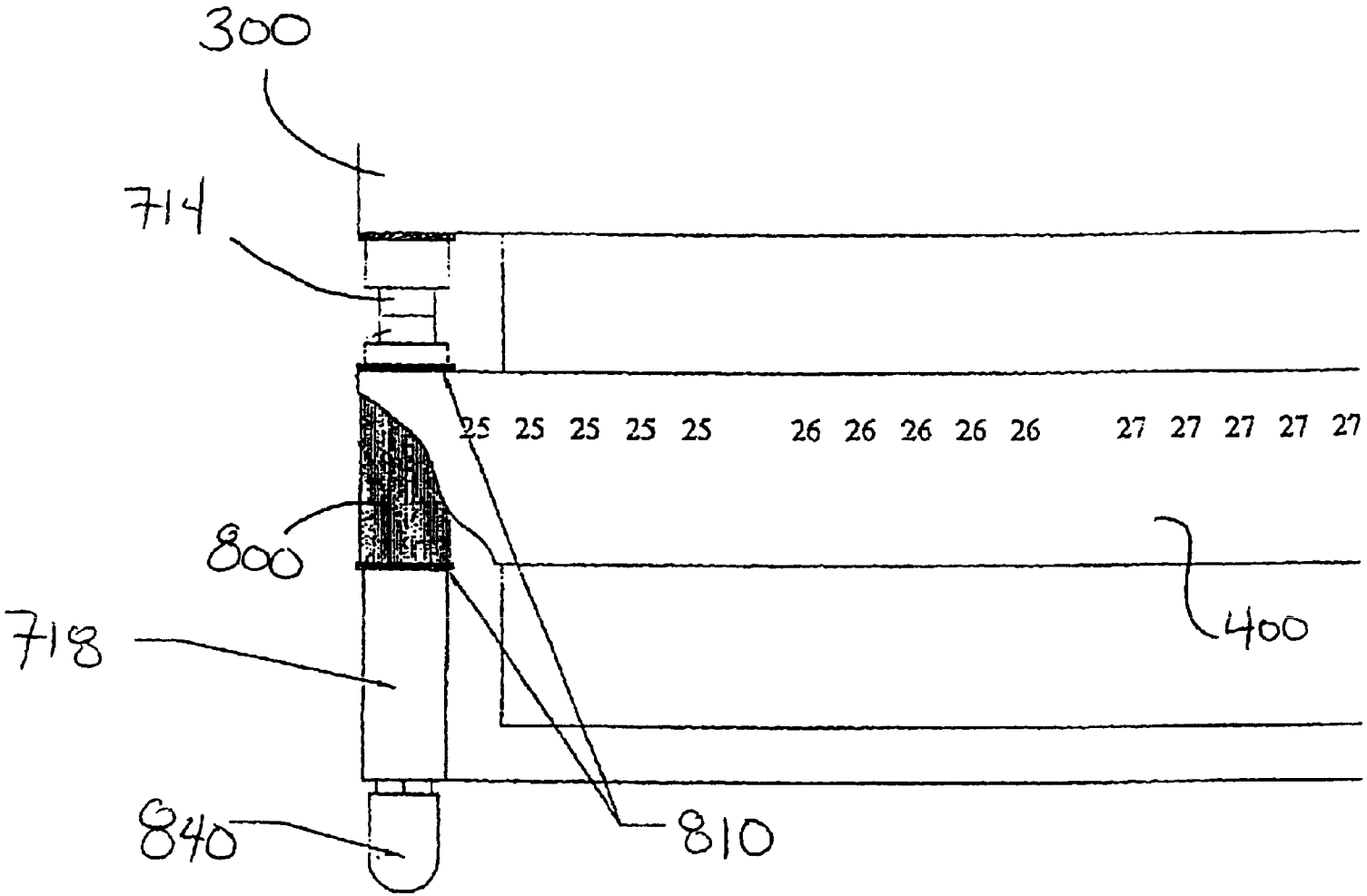
FIG. 8 is a cutaway front view of a spindle mechanism of the embodiment shown in FIG. 7.
Figure 9:
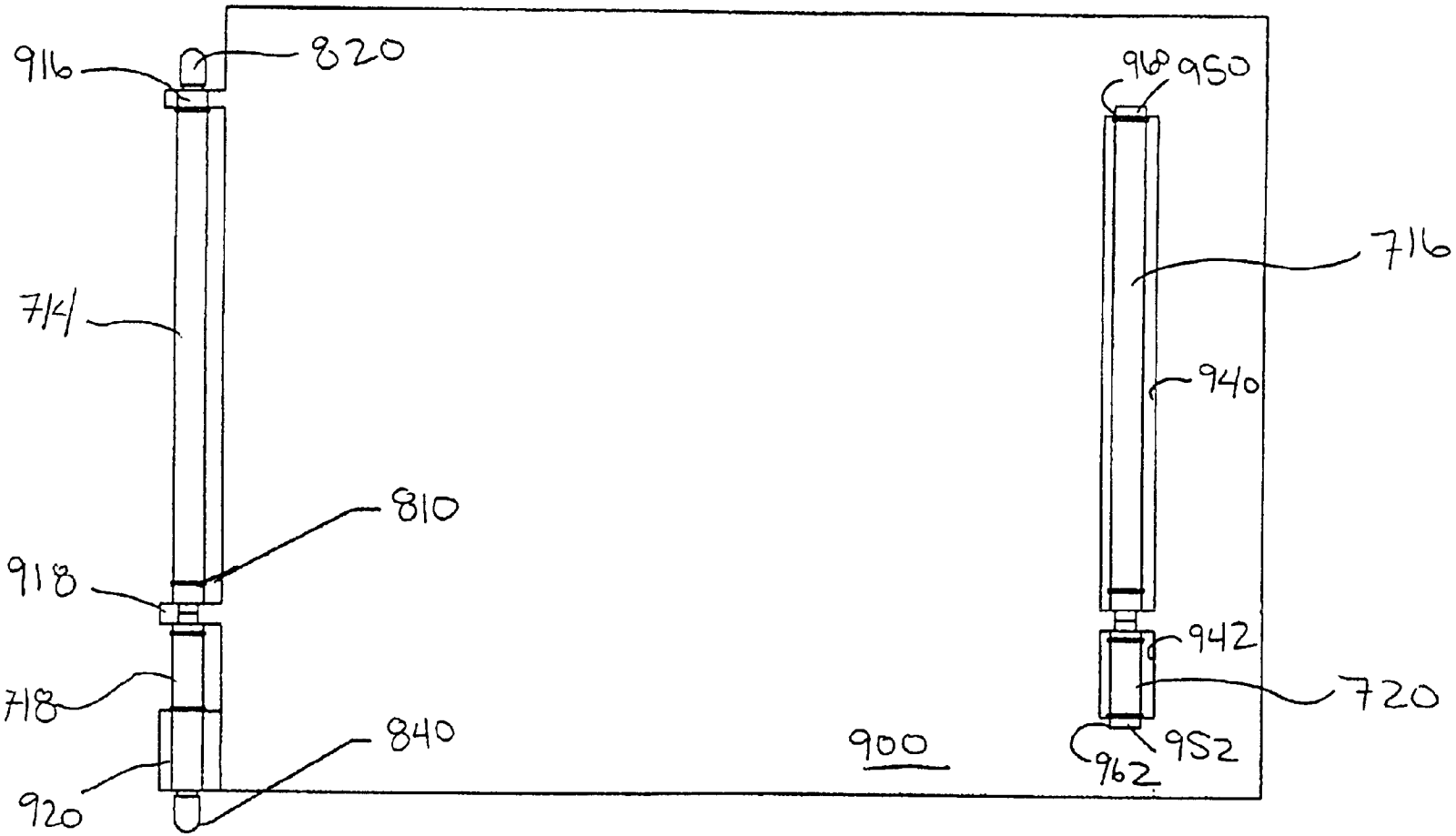
FIG. 9 is a plan view of the spindle mechanism and base board of the embodiment shown in FIG. 7.

An alternate embodiment of a perpetual calendar is shown in FIGS. 7–9. In this embodiment, the upper date scroll 300 and lower date scroll 400 are similar to those described above with reference to FIGS. 1–6*b*. A front panel 700 also includes a similar month grid 114, message area 106, reminder pad 108, next month pad 112, day windows 160 and layer 170.

The front panel 700 also includes a two-sided year-in-view insert 704 displaying an accurate date matrix for every month of a given year on each side, which can slide into a year-in-view receiving area 702. A clear plastic frame 703 that is slidably fixed to the year-in-view receiving area 702 can slide to frame the current month.

Two upper date spindles 714 and 716 and two lower date spindles 718 and 720 are rotatably connected to a base 900 so that the spindles 714, 716, 718 and 720 can freely rotate on a vertical axis. In this embodiment, the spindles 714 and 718 are surrounded by rings 916, 918 and 920 projecting horizontally from the base 900. One ring 918 surrounds a narrow portion at the junction of the spindles 714 and 718 to maintain vertical alignment of the spindles 714 and 718 with the front panel 700 and axial alignment of the spindles 714 and 718 with each other. Spindles 716 and 720 are positioned in openings 940 and 942 with their end portions 950 and 952 sitting within concave seats 960 and 962 on the base 900 so that the spindles 716 and 720 can freely rotate and the scrolls 300 and 400 can loop around the base 900 through the openings 940 and 942. One skilled in the art will understand numerous other methods to rotatably connect the spindles to the base, back panel, or front panel.

The upper date spindles 714 and 716 rotate on their axes independently of the lower date spindles 718 and 720. In this embodiment, each upper date spindle 714 and 716 is rotatably connected to a lower date spindle 718 and 720, respectively, so that the upper and lower date spindles 714 and 718 or 716 and 720 rotate on the same axis. However, it is also within the scope of the invention for the upper and lower date spindles to rotate on different axes.

The upper date scroll 300 and lower date scroll 400 loop around the upper date spindles 714 and 716 and the lower date spindles 718 and 720, respectively. Each spindle is wrapped with a strip of foam material 800 that is bordered along its top and bottom with raised rings 810. The foam material increases friction on the scrolls 300 and 400 to more effectively slide them relative to the front panel 700. The raised rings are spaced from each other at a distance similar to the height of the upper date scroll 300 or lower date scroll 400 to maintain the vertical alignment of the scrolls 300 and 400 with the front panel 700.

Upper and lower turning knobs 820 and 840 are fixed to and project vertically up and down, respectively, from an upper date spindle 714 and a lower date spindle 718. This arrangement allows a user to turn the upper turning knob 820 to move the upper date scroll 300 horizontally and the lower turning knob 840 to move the lower date scroll 400 horizontally, relative to the front panel 700.

Although the foregoing describes the invention in terms of embodiments, the embodiments are not intended to limit the scope of the claims. Rather, the claims are intended to cover all modifications and alternative constructions falling within the spirit and scope of the invention, and are limited only by the plain meaning of the words as used in the claims.

What is claimed is:

1. A perpetual calendar comprising:

a front panel permanently displaying a month grid of cells and weekday labels, the front panel selectively displaying preprinted numbers in the month grid of cells in an accurate configuration and number of days for any month, wherein at least some of the preprinted numbers are arranged as clusters of repeated, identical numbers.

2. The perpetual calendar of claim 1, wherein the cells include windows therein, the calendar further comprising:

at least one surface coupled to and movable behind the front panel, the at least one surface having numbers permanently printed thereon, the numbers spaced such that when the at least one surface is moved, the accurate number and configuration of days for any month can be displayed through the windows.

3. A perpetual calendar comprising:

a front panel permanently displaying a month grid of cells and weekday labels, the front panel selectively displaying preprinted numbers in the month grid of cells in an accurate configuration and number of days for any month; and an at least semi-transparent sheet coupled to and in front of the front panel and having a write-on/wipe-off surface, wherein the month grid of cells has a plurality of upper rows and at least one lower row, and the at least one surface further comprises:

a first surface having a first number matrix displayed thereon, the first surface horizontally movable behind the plurality of upper rows; and a second surface having a second number matrix displayed thereon, the second surface horizontally movable behind the at least one lower row, wherein the first number matrix is arranged such that by moving the first surface horizontally in relation to the front panel, a plurality of numbers of the first number matrix are visible through the windows in the upper rows to accurately represent sequential dates of the upper rows of a calendar for a month starting on any weekday, and wherein the second number matrix is arranged such that by moving the second surface horizontally in relation to the front panel, a portion of the second surface is visible through at least one window of the at least one lower row, to accurately represent sequential dates for the at least one lower row of a calendar numbered for a month beginning on any weekday and having an accurate number of days for any month.

4. The perpetual calendar of claim 2, further comprising a base coupled to the front panel and slidably coupled to the at least one surface such that the at least one surface maintains alignment with the front panel perpendicular to a direction of movement.

5. The perpetual calendar of claim 1, further comprising a month surface coupled to and movable behind the front panel, the month surface having a list of month names permanently displayed thereon, wherein the front panel further comprises a month window sized and located such that when the month surface is moved, one month from the list of month names is visible through the month window.

6. The perpetual calendar of claim 1, further comprising:

a list of months displayed on the front panel; and a month marker coupled to the front panel and located at least partially in front of the list of month names to mark a current month.

7. The perpetual calendar of claim 6, wherein the list of month names is a horizontal array and the month marker is slidable along the front panel.

8. The perpetual calendar of claim 7, further comprising a month receiver fixedly coupled to the front panel, the month receiver configured to hold the list of month names in alignment with the front panel.

9. The perpetual calendar of claim 7, wherein the list of month names includes an array of day configurations for each month of a year proximate to each month name in the list of month names.

10. The perpetual calendar of claim 2, wherein the at least one surface is formed as a loop of flexible material.

11. The perpetual calendar of claim 5, wherein the month surface is formed as a loop of flexible material.

12. The perpetual calendar of claim 1, further comprising one of a wet-erase marker and a dry-erase marker.

13. The perpetual calendar of claim 2, further comprising a first axially rotational spindle coupled to the at least one surface such that upon rotating, the spindle engages the at least one surface and moves it to display the accurate number and configuration of days for any month.

14. The perpetual calendar of claim 3, further comprising:

a first axially rotational spindle coupled to the first surface such that upon rotating, the spindle engages the first surface and moves it horizontally; and a second axially rotational spindle coupled to the second surface such that upon rotating, the spindle engages the second surface and moves it horizontally.

15. The perpetual calendar of claim 13, wherein the at least one surface is coupled on one end to the spindle and is coupled on an opposite end to an axially rotatable rod.

16. A perpetual monthly calendar comprising:

a front panel having a grid of cells representing a month displayed thereon, each cell having a window, and the grid having seven columns representing weekdays, a plurality of upper rows representing upper rows of a monthly calendar and at least one lower row representing at least one lower row of a monthly calendar;

a first surface having a first number matrix displayed thereon, the first surface coupled to the front panel and horizontally movable behind the plurality of upper rows; and a second surface having a second number matrix displayed thereon, the second surface coupled to the front panel and horizontally movable behind the at least one lower row;

wherein the first number matrix is arranged such that by moving the first surface horizontally in relation to the front panel, a plurality of numbers of the first number matrix are visible through the plurality of windows in the upper rows, and can accurately represent sequential dates of the upper rows of a calendar for a month starting on any weekday, and wherein the second number matrix is arranged such that by moving the second surface horizontally in relation to the front panel, portion of the second surface is visible through at least one window of the at least one lower row, and can accurately represent sequential dates for the at least one lower row of a calendar numbered for a month beginning on any weekday and an accurate number of days for any month.

17. The perpetual monthly calendar of claim 16, further comprising an at least semi-transparent sheet coupled to and in front of the front panel and having a write-on/wipe-off surface.

18. The perpetual calendar of claim 1, further comprising:

an at least semi-transparent sheet coupled to and in front of the front panel and having a write-on/wipe-off surface.

* * * * *